US006551083B2

(12) United States Patent
Weisener et al.

(10) Patent No.: US 6,551,083 B2
(45) **Date of Patent: *Apr. 22, 2003**

(54) MICROMOTOR AND MICROPUMP

(75) Inventors: Thomas Weisener, Ditzingen (DE); Gerald Voegele, Magstadt (DE); Mark Widmann, Boennigheim (DE); Carlo Bark, Schoerzingen (DE); Andreas Hoch, Heilbronn (DE)

(73) Assignee: Fraunhofer Gesellschaft zur Foerderung der Angewandten Forschung E.V., Munich (DE)

( * ) Notice: Subject to any disclaimer, the term of this patent is extended or adjusted under 35 U.S.C. 154(b) by 191 days.

This patent is subject to a terminal disclaimer.

(21) Appl. No.: 09/727,210

(22) Filed: Nov. 30, 2000

(65) Prior Publication Data

US 2002/0015653 A1 Feb. 7, 2002

Related U.S. Application Data

(63) Continuation of application No. 09/043,790, filed as application No. PCT/DE96/01837 on Sep. 26, 1996, now Pat. No. 6,179,596.

(30) Foreign Application Priority Data

Sep. 26, 1995 (DE) ..... 951 15 152
May 30, 1996 (DE) ..... 951 08 658

(51) Int. Cl.[7] ..... F03C 2/08; F04C 2/10
(52) U.S. Cl. ..... 418/166; 418/171; 29/888.023
(58) Field of Search ..... 418/166, 171; 29/888.023

(56) References Cited

U.S. PATENT DOCUMENTS 2,711,286 A 6/1955 McAdam ..... 230/139
3,303,783 A 2/1967 Neubauer ..... 418/166 X
3,398,886 A 8/1968 Roach ..... 230/206
4,361,419 A 11/1982 Vohringer ..... 418/171 X
4,443,169 A 4/1984 Merz ..... 418/171

(List continued on next page.)

FOREIGN PATENT DOCUMENTS

| | | |
|---|---|---|
| DE | 1138639 | 10/1962 |
| DE | 1703802 | 4/1972 |
| DE | 3114871 | 11/1982 |
| DE | 3342385 | 6/1985 |
| DE | 4303328 | 8/1994 |
| GB | 786966 | 11/1957 |
| GB | 2085969 | 5/1982 |
| JP | 2027181 | 9/1990 |
| JP | 2277983 | 11/1990 |

OTHER PUBLICATIONS

Microparts Catalog (6 pages) No Date.
Jung–FluidTechnik GmbH Catalog, 6/94 (5 pages).
Jung–Mikro–Pumpen Catalog (2 pages) No Date.
Scherzinger Pumpen (4 pages), No Date.
Hydraulik Nord Catalog, GMP pp. 3,4,5,10. Dr.–Ing.W. Steiss, Pumpen–Atlas, Teil I, 2/95, pp. 153–158.

(List continued on next page.)

*Primary Examiner*—Hoang Nguyen
(74) *Attorney, Agent, or Firm*—Duane Morris LLP

(57) ABSTRACT

The invention concerns a micropump for the substantially continuous delivery of a mass flow, the micropump having a sleeve axis and an offset axis of rotation. An internal rotor meshes with an external rotor in a sleeve and at least one outlet-side pressure opening in a first end-face termination part. Both rotors have a dimension smaller than 10 mm. The invention further concerns a micromotor of similar construction in which the diameter of the rotors and the casing are below 10 mm. The pump and motor are extremely miniaturized yet still permit a continuous flow with high feed pressure and high output.

19 Claims, 10 Drawing Sheets

U.S. PATENT DOCUMENTS

| | | | | |
|---|---|---|---|---|
| 4,533,302 | A | 8/1985 | Begley | 418/61 B |
| 4,857,054 | A | 8/1989 | Helfer | 604/102 |
| 4,897,025 | A | 1/1990 | Negishi | 418/171 |
| 5,135,371 | A | 8/1992 | Arbogast et al. | 418/124 |
| 5,219,276 | A | 6/1993 | Metzner et al. | 417/356 |
| 5,263,818 | A | 11/1993 | Ito et al. | 418/171 |
| 5,466,137 | A | 11/1995 | Bierlein et al. | 418/171 X |
| 5,554,019 | A | 9/1996 | Hodge | 418/171 |
| 6,179,596 | B1 | 1/2001 | Weisener et al. | 418/171 |

OTHER PUBLICATIONS

Bosch Catalog, Hydro–Kleinaggregate EP.9, Von Bosch (2 pages) No Date.

Casappa Catalog, Italy, 1/95 (3 pages).

Danfoss Catalog Hydraulikmotoren–die Verborgene Kraft (10 pages) No Date.

Eckerle Re xroth Catalog, Innenzahnradpumpen GC/GH/GF,9/94 (6 pages).

Eaton Zahnradpumpen, pp. 21–22, No Date.

MICROMOTOR AND MICROPUMP

CROSS REFERENCE TO RELATED APPLICATION

This is a continuation of U.S. application Ser. No. 09/043,790, filed Sept. 2, 1998, issued on Jan. 30, 2001 as U.S. Pat. No. 6,179,596 which is a 371 of PCT/DE96/01837 filed Sep. 26, 1996.

BACKGROUND OF THE INVENTION

1. Field of the Invention

The invention relates to pumps and motors of smallest constructional size, in the following referred to as one of micropump and micromotor. The terms designating orders of magnitude, being of a diameter range below 10 mm, particularly less than 3 mm. Such pumps may find manifold uses in the technical and medical sectors, for instance in microsystems engineering in dosing apparatuses, in medical engineering, as a drive means for one of a micro milling cutter and a bloodstream support pump.

2. Prior Art

Prior art is rich of specifications regarding the principle and the function of gear pumps having an inner wheel and an outer wheel, the wheels being in mating/meshing engagement (compare DE-A 17 03 802, claim 1, page 4, last paragraph and page 6, last paragraph, disclosing radially directed inflow and outflow channels). These operational units to be used as one of pumps and motors are characterized by having two axes, one axis of an inner rotor and another axis of an outer rotor, which axes are offset with respect to each other, and which rotors being in meshing engagement to circumferentially form pressure spaces (pressure chambers) cyclically changing their size and position.

SUMMARY OF THE INVENTION

The object of the invention is to provide a micropump of a minimum constructional volume, with which pump a continuous flow of a fluid to be conveyed is achieved and at the same time a high conveying capacity and a high feed (discharge) pressure are obtained.

Said object is achieved with a micropump, wherein an outlet pressure opening of a face end insert part for a sleeve casing of slightly larger diameter is adapted to extend in an axial direction. An inlet opening of a second face end insert part for the sleeve casing of slightly larger diameter may also be adapted to extend in axial direction. Thus, the entire pump is in a position to generate a continuous flow of fluid in axial direction, which flow is oriented to a circumferential direction only in an inner portion of the pump, where the rotors are in meshing engagement to circumferentially displace the pressure chambers. As soon as the flow of fluid to be conveyed enters the face end insert part on the outlet side, it is discharged from there in the axial direction through a pressure opening extending in axial direction. The pressure opening may consist of a number of individual bores arranged at circumferential intervals, it may consist of one single bore and it may be provided by one bore together with a kidney-shaped receiving groove on the inside surface of the outlet insert part.

The advantage of the pumps provided according to the invention is that, despite their almost unimaginable miniaturization, they are of a simple structure. An assembly of the micropump being available by a manufacturing method, wherein substantially cylindrical parts as components being assembled in a uniaxial direction. The two end insert components, being inserted in axial direction, are positioned at both ends of the sleeve casing, while the meshing wheels (inner rotor and outer rotor) which are likewise inserted in (the same) axial direction are interposed axially between them.

The pump is driven for example on an extended end portion of the shaft of the inner rotor or radially via the casing by one of a mere mechanical and electromechanical force. If an electromechanical drive force is used, e. g. one of the outer rotor and the sleeve casing may for a far reaching miniaturization be provided with integrated magnets, to serve as a rotor of a synchronous drive, the radially outer sleeve casing, which has a further outside radial position, permitting a penetration of electromagnetic fields.

Advantageously, slight conveying losses resulting from circumferential inexactnesses are used as a bearing for each respective rotatable component in the casing.

A motor for driving the pump is also characterized by being of smallest constructional size, simultaneously providing a high power density and even presenting a favorable characteristic line (torque in relation to speed). If the number of revolutions is not too high, the motor achieves a torque permitting to drive a pump without gearing. The driving energy of the motor is generated by a fluidic flow, passing the meshing wheels (inner rotor and outer rotor) and being discharged to the environment at the outlet side. A drive fluid enters through an inlet tubing or connection piece which is adapted to be fixedly mounted at the sleeve casing of the insert part or at the insert part itself.

When mounted at the face end insert, said insert may be slightly to markedly extended in relation to the sleeve casing to provide a firm fit for the inlet tubing.

The mounting of the inlet tubing implicates that the inlet tubing has about the same diameter as the micromotor.

If a fluidic drive is used, there is no difficulty with regard to an electric insulation for smallest constructional sizes. The fluidic drive medium may simultaneously serve as coolant, lubricant, rinsing medium and bearing fluid.

The motor consists of the same components as the pump, only different operational elements are one of fixedly and rotatably connected with each other. When uniaxially assembling the mentioned operational elements, a number of embodiments are provided to realize the motor and the pump, depending on which part is fixedly mounted on which, which part is rotatably mounted on which and which part the arrangement uses as a support on a fixed position. Using an inlet tubing as drive, the inlet tubing itself is the support. Driving the pump by an extended shaft portion, an elongated drive shaft is used.

BRIEF DESCRIPTION OF DRAWINGS

In the following, the invention is described in detail on the basis of several embodiments.

FIG. 7*b* shows an electromechanical drive according to the principle of a synchronous motor.

DETAILED DESCRIPTION OF THE PREFERRED EMBODIMENT

Figure 1:
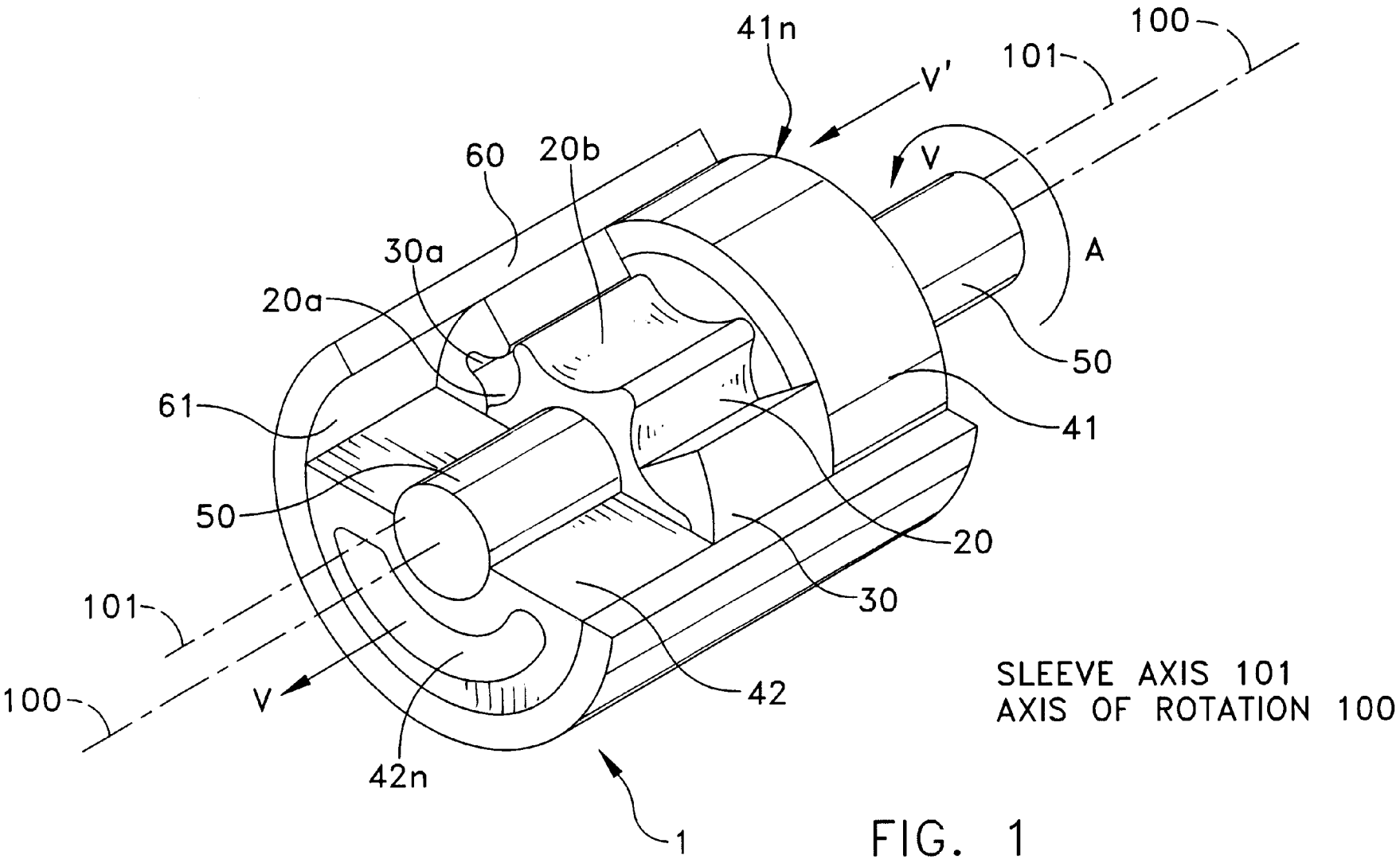
FIG. 1 is an embodiment of a pump 1 having a termination part 41 and a drive shaft 50.

FIG. 1 shows a diagrammatic sketch of a micropump 1 which has a diameter of the order of below 10 mm, but which, preferably by manufacturing processes of wire spark erosion and cavity sinking, can be reduced to sizes of less than 2.5 mm in diameter. The length of the pump is in the latter diameter of 2.5 mm about 4 mm only, measured in the axial direction 100.

Other manufacturing methods may also be used, such as LIGA engineering, plastics injection molding, ceramics injection molding, extrusion molding, metal sintering and micromilling or microturning or general microcutting.

The micropump 1 consists of a casing 60 in which five operational elements are integrated, some of them movably, some of them fixed, whereby in the after "fixed integration", operational elements which do not perform a relative movement with respect to each other or which by their function require a fixed connection may also be manufactured as one part if allowed by the manufacturing process. At each end face of the casing 60 there is a face end insert 41 and 42, respectively, both having an eccentric bore for receiving a pump shaft 50. The bores are flush along a first axis 100 which is slightly radially offset to the outside in relation to the center axis 101 of the casing 60.

Figure 3C:
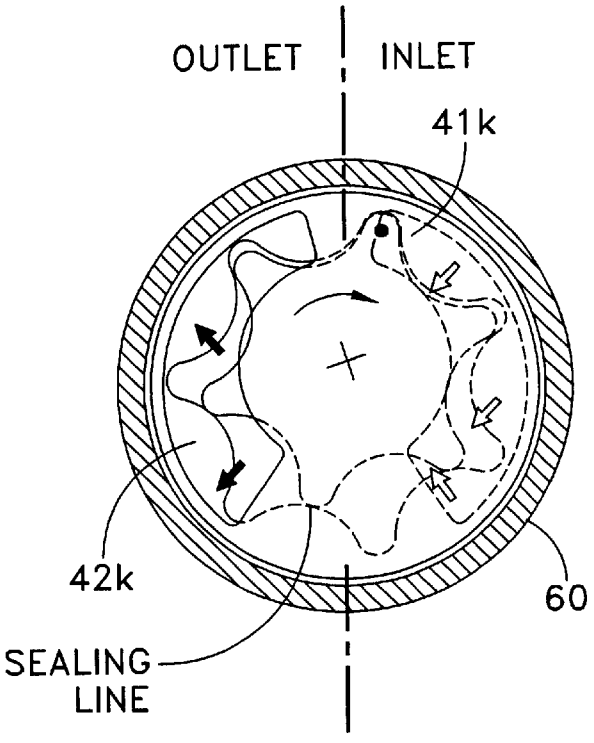
FIG. 3*a*, FIG. 3*b* and FIG. 3*c* show three radial positions of an inner rotor 20 in relation to an outer rotor 30, both rotors being in meshing engagement.
Figure 3B:
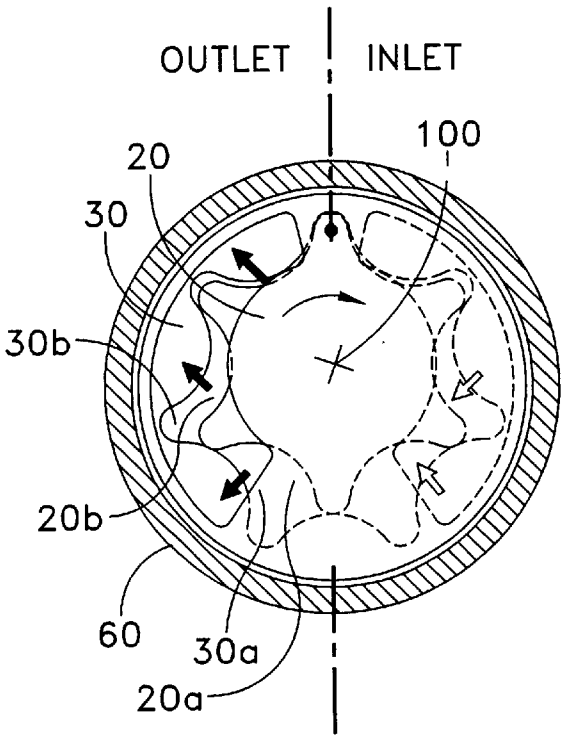
Figure 3A:
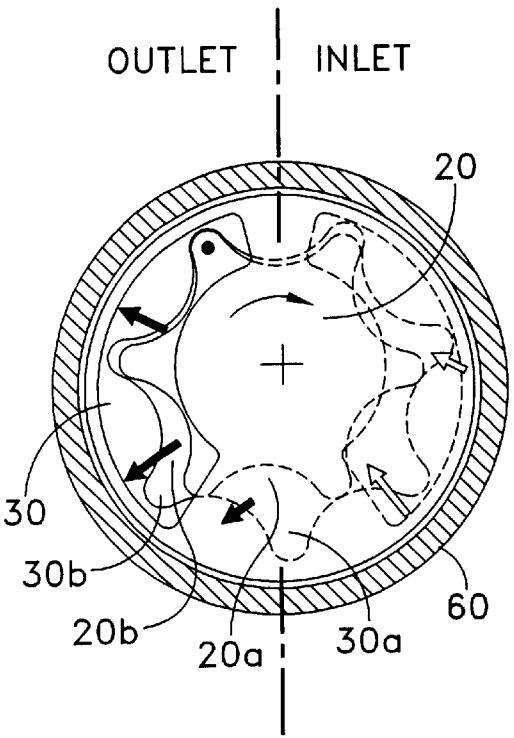

The two end inserts 41, 42 are at an axial distance from each other, and between them there are two rotors which rotate with one another and engage into one another, an outer rotor part 30 and an inner rotor part 20. The inner rotor 20 has outwardly directed teeth distributed at uniform intervals about its circumference. The teeth engage with the outer rotor part 30 which has longitudinal grooves 30*a*,30*b*, . . . which open inward and which are distributed circumferentially at uniform intervals and, in their shape, match the teeth of the inner rotor 20, such that each tooth of the inner rotor—when performing its meshing rotational movement—forms an axially directed sealing line on the inner surface of the corresponding groove 30*a*,30*b*, . . . of the outer rotor 30. All the sealing lines move in the drive direction A about the axis 100, whereby, when performing a rotational movement in a direction towards the end of the outlet opening 42*n*, transport or pump chambers 20*a*,30*a*;20*b*,30*b* (etc.) which are defined between two sealing lines, respectively, are reduced in their volume on one half of the pump, as shown in FIGS. 3*a* to 3*c*, and continuously increase on the opposite half of the pump to obtain a recurring cycle of minimum and maximum chamber volumes and vice versa.

The inner wheel 20 provides a rotational movement together with the drive shaft 50, a drive mechanism can couple in a rotary movement A via a longer flexible shaft, an electrical drive mechanism can also be arranged directly on the shaft 50.

Figure 1A:
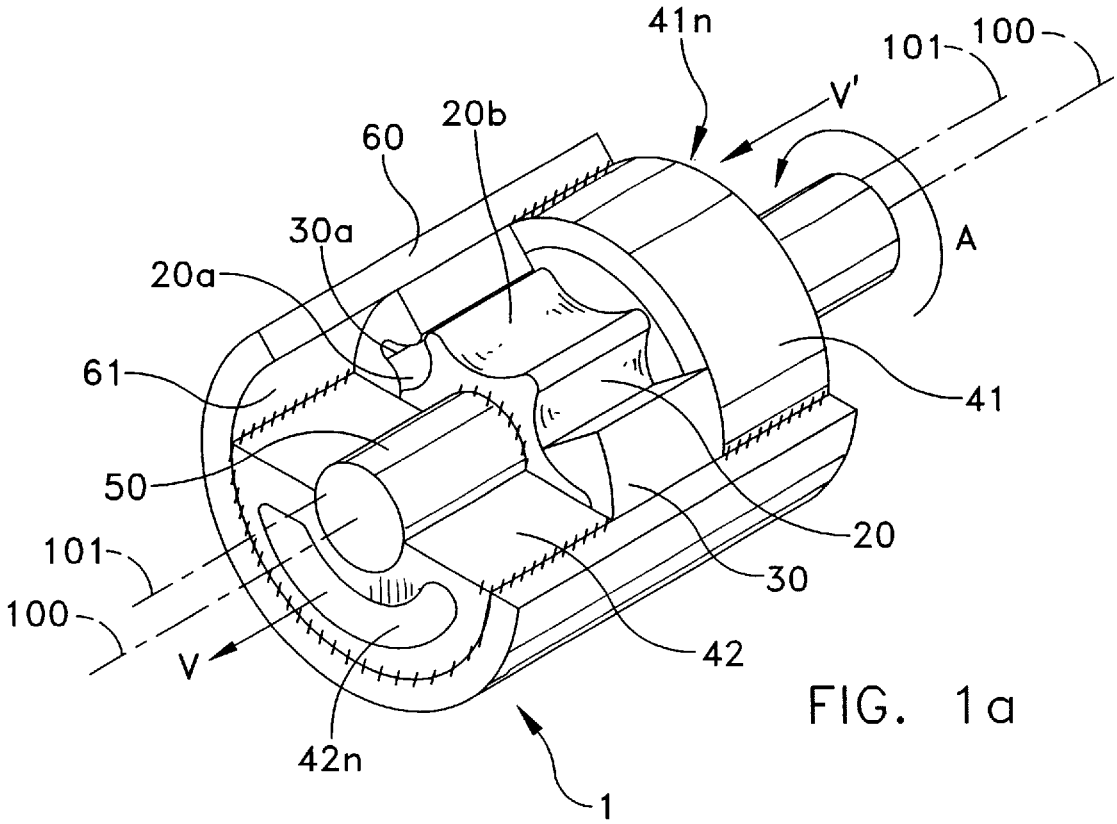
FIG. 1*a* illustrates an embodiment of adapting the components according to FIG. 1 to be one of fixedly and rotatably mounted in relation to each other, hatches indicating a fixed mounting. Surfaces adjoining each other and not being hatched in the border area are movable in relation to each other.

FIG. 1*a* illustrates an embodiment of a definition of fixed border areas (closely adjacent surfaces of two adjoining parts of the pump). Hatches indicate a fixed (non-rotatable) border area, the remaining border areas allow a rotational movement of the adjacent parts.

While the rotation shaft 50 together with the inner wheel 20 arranged fixedly thereon and the outer wheel 30 are rotatable in the sleeve casing, the other parts of this embodiment of a micropump—the face end inserts 41, 42 and the sleeve casing 60 extending along the length of the pump 1—are connected circumferentially to one another in a fixed manner. The shaft 50 is rotatably mounted in the bores of the end inserts 41, 42, and the outer wheel 30 is likewise rotatably mounted in the fixed casing 60. Thus, in the embodiment of a rotary drive via the shaft 50 according to FIG. 1*a*, represented by an angle velocity vector A, both the outer wheel 30 and the inner wheel 20 move with a rotational movement of the sealing lines as shown in FIG. 3 and simultaneously changing chamber volumes 20*a*, 30*a* (etc.) between the outer wheel and the inner wheel during rotation.

The fixed border areas may for example be manufactured by gluing. The chamber volumes decrease in the direction toward the smallest distance between the axis 100 of the rotation shaft 50 and the casing 60, as a result of which the fluid conveyed in them is subjected to increased pressure, whereas they become larger again on the other side after exceeding the smallest distance between axis 100 and inner surface 61 of the sleeve casing 60.

Together with kidney-shaped openings 41*n*, 42*n* in the end faces 41, 42, which are so arranged that their smallest radial width begins at the position at which the distance between the axis 100 and the inner surface 61 of the casing 60 is at its smallest, whereas their maximum radial width is located at the position which is close to the greatest distance of axis 100 from the inner surface 61 of the casing 60, a feed pump is obtained. The inflow kidney 41*n*, which is situated on the side for the suction of the fluid V' to be conveyed, is mounted in the opposite direction to that outflow kidney 42*n* which in FIG. 1*a* is represented at the outflow position for the delivered (discharged) volume V being conveyed under pressure. FIG. 1*a* thus shows on the inflow side an inflow kidney 41*n* which, in the shown rotational direction A of the pump, widens in its radial extension from the smallest distance of the axis 100 to the greatest distance of the axis 100 from the inner surface 61, while the inflow kidney 41*n* is situated in the face end insert 42 and narrows, in its radial extension, with its greatest radial width from the position of the greatest distance of the axis 100 from the inner surface 61 of the sleeve casing to the smallest distance of the axis 100 from the inner surface 61 of the casing 60.

The dimensioning and the change in width of the two kidneys 41*n*, 42*n* are adapted to the following criteria:

A short circuit of the delivery, i.e. a direct connection between the inlet kidney and the outlet kidney, is prevented in all positions of rotation;. thereby, the circumferential extension of the reniform openings 41,42*n* is defined.

The inlet and outlet cross section of the kidneys—the change in radial dimensioning—is oriented to the root diameter of the outer wheel 30 and the root diameter of the inner wheel 20. The cross-sectional surface should be chosen as large as possible, in order to obtain minor pressure losses, at any rate maintaining the stated dimensional specifications.

Figure 8:
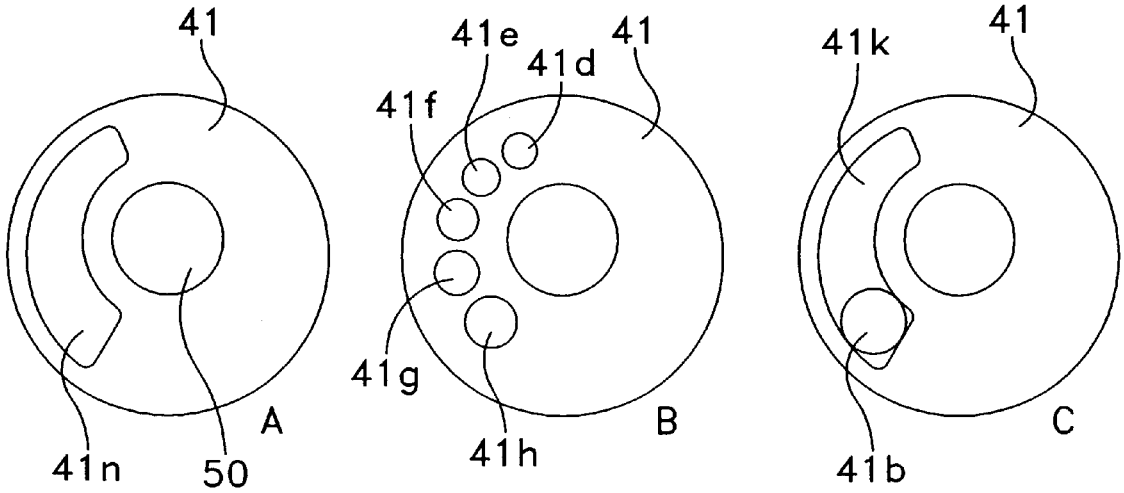
FIG. 8 consists of three sketches A, B and C, illustrating three different embodiments of inlet and outlet openings 41*n*, 42*n* located in the face end parts 41, 42 according to FIG. 1.

The two kidneys can alternatively be incorporated also as curved grooves 41*k*, 42*k* into the inner flat wall of the end faces, in which case a cylindrical bore 41*b*,42*b* is then provided in the axial direction of the pump as outlet and inlet, respectively. This increases the stability, which, with the small component sizes, is not unimportant. Different embodiments of inlet and outlet kidneys are illustrated in FIG. 8.

A single production of the pump consisting of only six components or less is advantageously possible with the stated wire spark erosion and cavity sinking, in which case all the pump parts can be adequately described with cylinder coordinates, which, for the production, means that one dimension requires no additional working. The end inserts 41 and 42 can be manufactured by wire spark erosion. The shaft 50 is cylindrical anyway, the inner rotor 20 can likewise be manufactured by wire spark erosion, as can the outer rotor 30. The casing 60, finally, is also a pump component, which can be manufactured by wire spark erosion.

If the aforementioned kidney-shaped inlet and outlet grooves 41*k*, 42*k* are made in the inner sides of the end inserts 41, 42, then cavity sinking can be used for this.

A material which is recommended for the manufacture of the micropump is hard-sintered metal which has a low stress and is fine-grained, can easily be worked by wire spark erosion and cavity sinking, and is medically acceptable. More favorable from the medical point of view is a ceramic material which, however, can only be processed in larger batch numbers and is not quite suited for the manufacture of individual functional samples. If the erosion methods are used, attention must be paid to the electrical conductivity of the material, if a ceramic injection molding process is used—with molds which can be made, for example, by wire spark erosion and cavity sinking—then the electrical conductivity of the material of the micropump is no longer necessary. In large batch numbers, plastic or metal injection molding processes can be used.

Figure 2A:
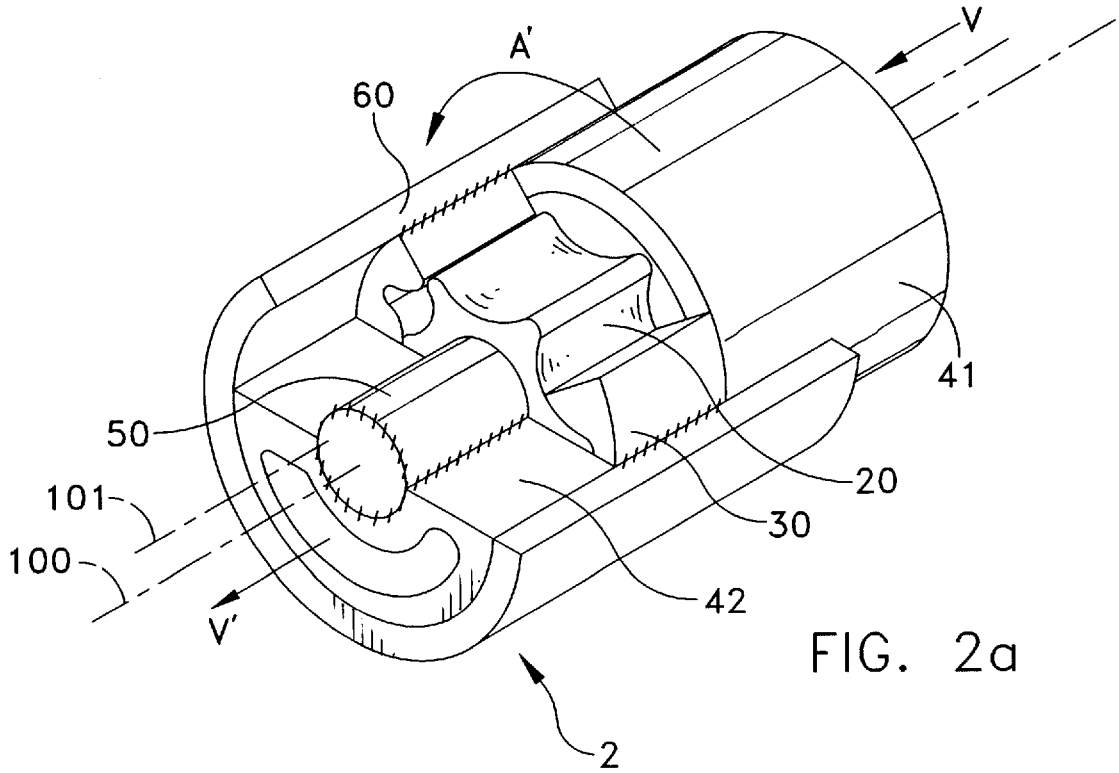
FIG. 2*a* illustrates an embodiment in which one of relatively movable and fixed "border areas" for a motor according to FIG. 2 are provided, hatches indicating a fixed border area.
Figure 2:
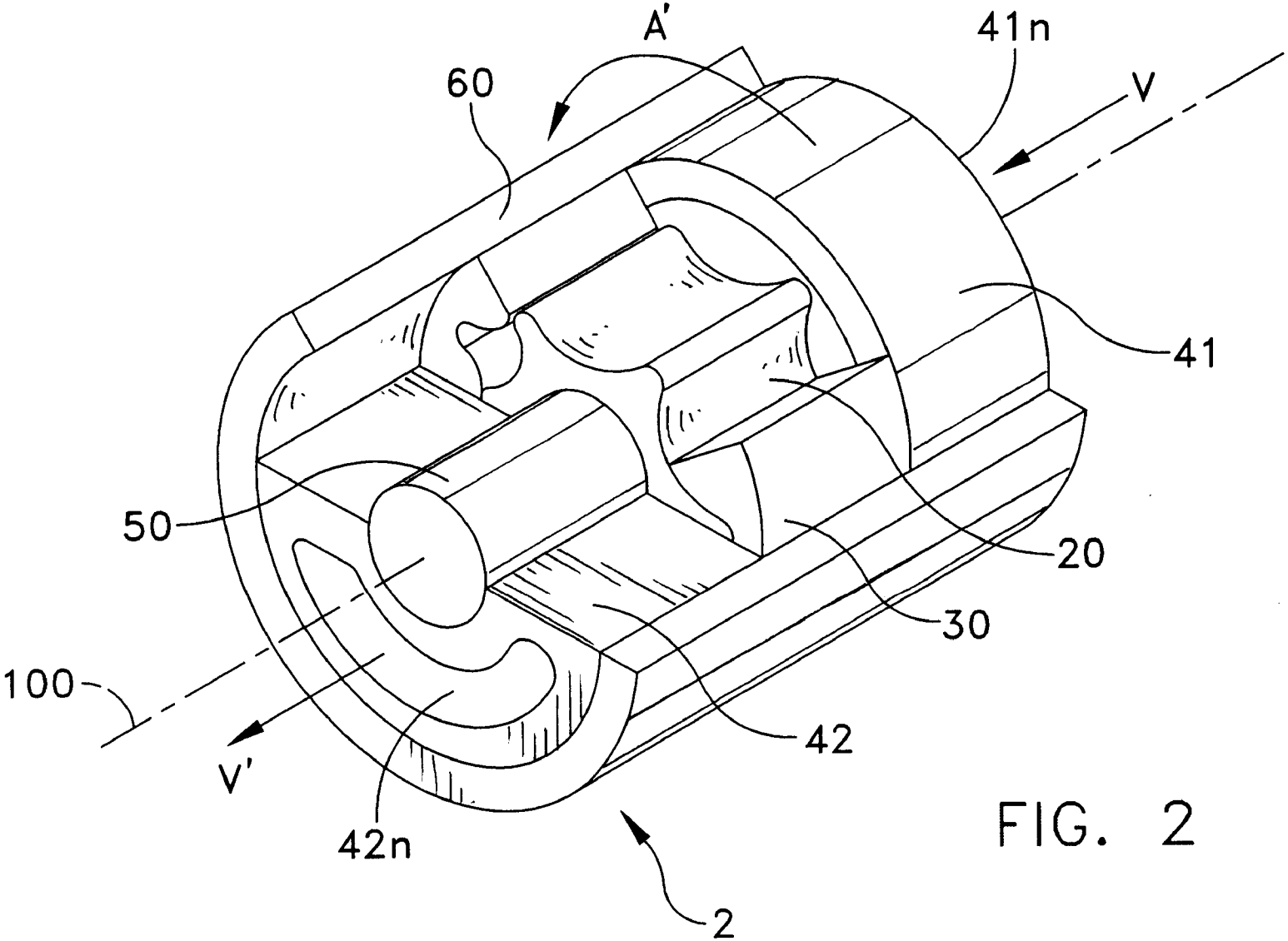
FIG. 2 illustrates an embodiment of a motor 2 having an extended termination part 41 on which an inlet tubing for a drive fluid may be attached.

The pump 1 described with reference to the FIGS. 1 and 1*a* and to the manufacturing process, may readily be used for medical purposes, such as catheters. Said drive A may be provided by a thin, flexible shaft. The drive of the micropump may also be effected by a motor 2 which is driven by a fluid, and which is made in the same way and has the same appearance as the described pump 1, only with said motor 2 a fluidic drive via the inflow kidney 41*n* with a tubing SH is chosen, which tubing is arranged fixedly on the insert 41 (FIGS. 2,2*a*). Since the casing 60 in the fluidic micromotor 2 is arranged fixedly on the outer wheel 30—for example by adhesive bonding or by a matching fit or by a weld or solder connection—the casing 60 is rotated and can transmit its output drive force A' to the drive A of the pump 1.

Said drive A' according to FIG. 2*a* has a mechanically rigid coupling to the drive shaft 50 of the pump 1 according to FIG. 1*a*.

Figure 7A:
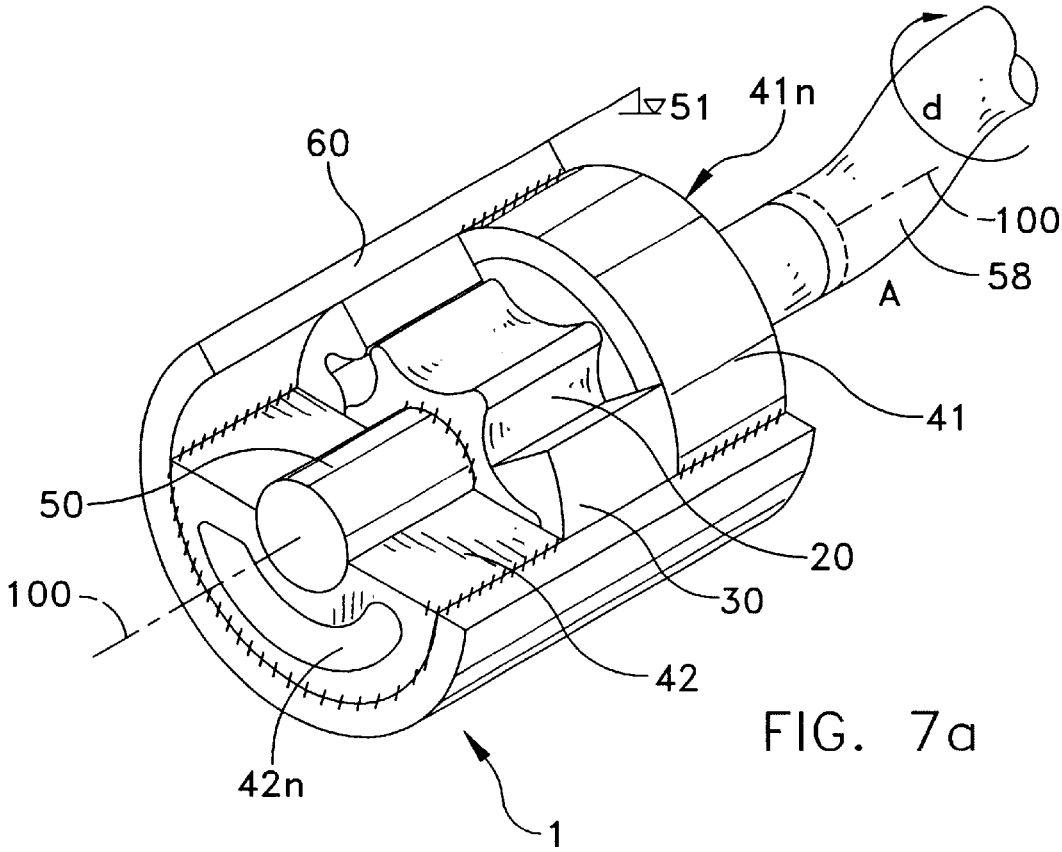
FIG. 7*a*, FIG. 7*b*, FIG. 7*c* and FIG. 7*d* are embodiments illustrating connections for a drive A on one of a shaft 50 and an insert part 41 and an outer casing 60 with a circumferential drive 63*a*, 63*b* as illustrated in the arrangement of FIG. 5.
Figure 7B:
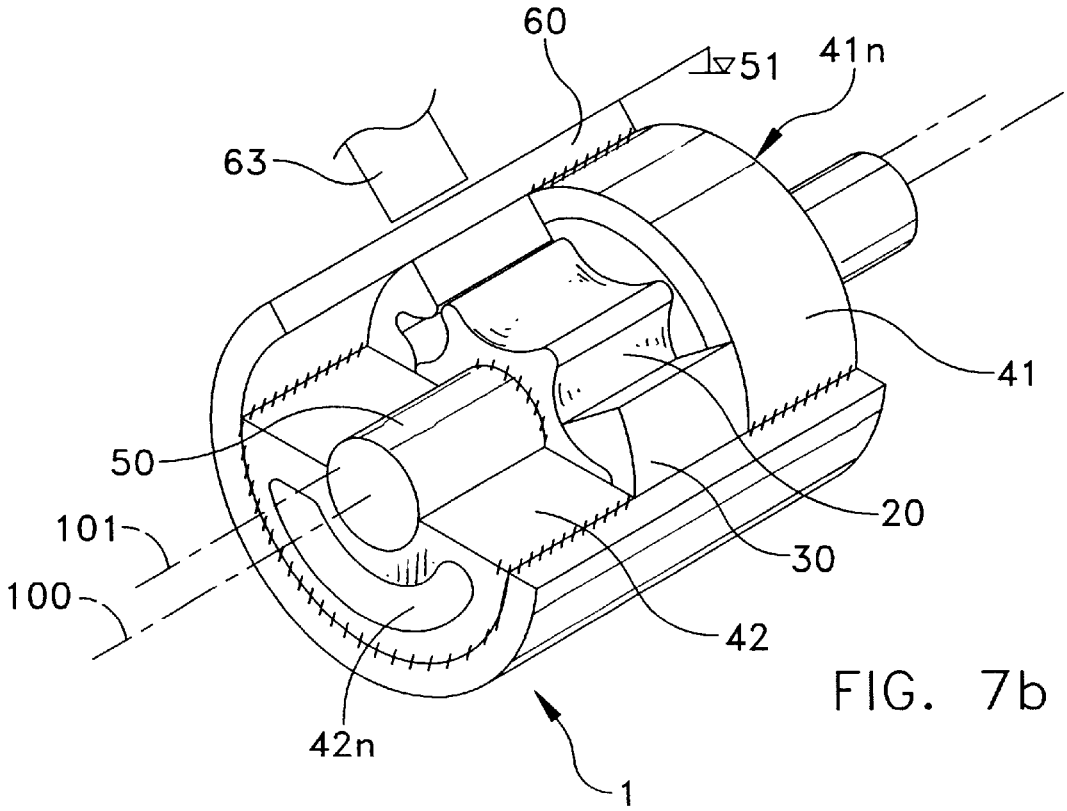
Figure 7C:
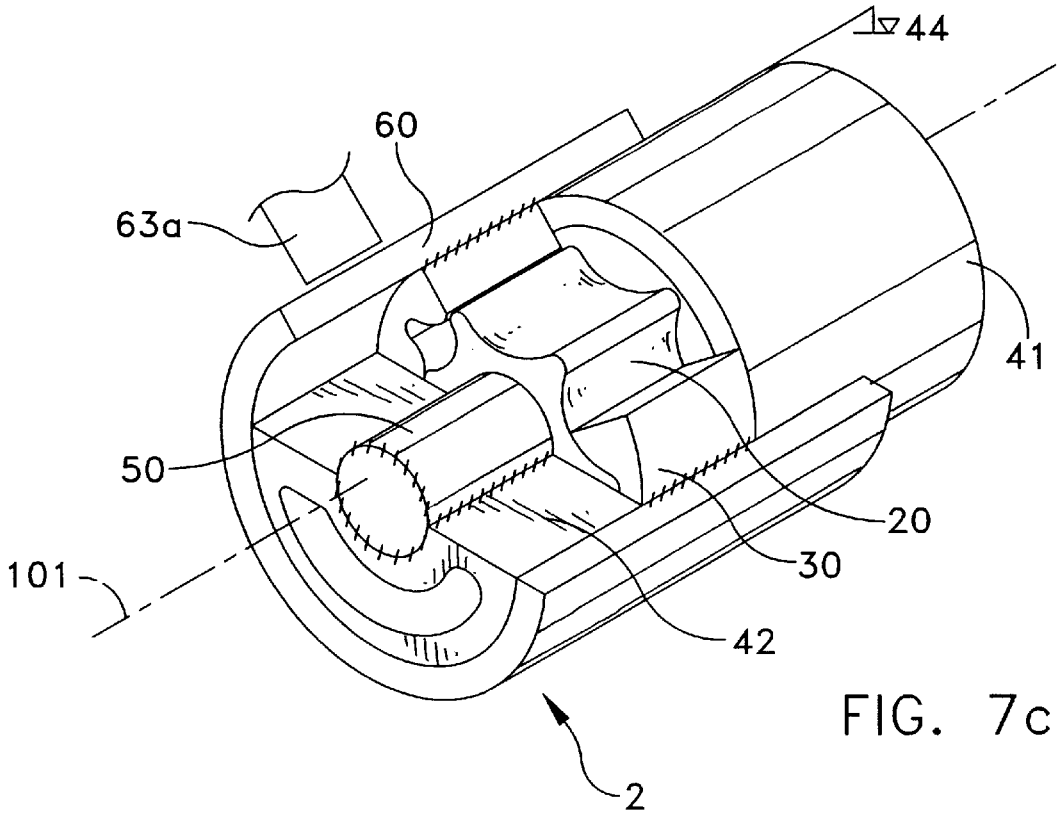
Figure 7D:
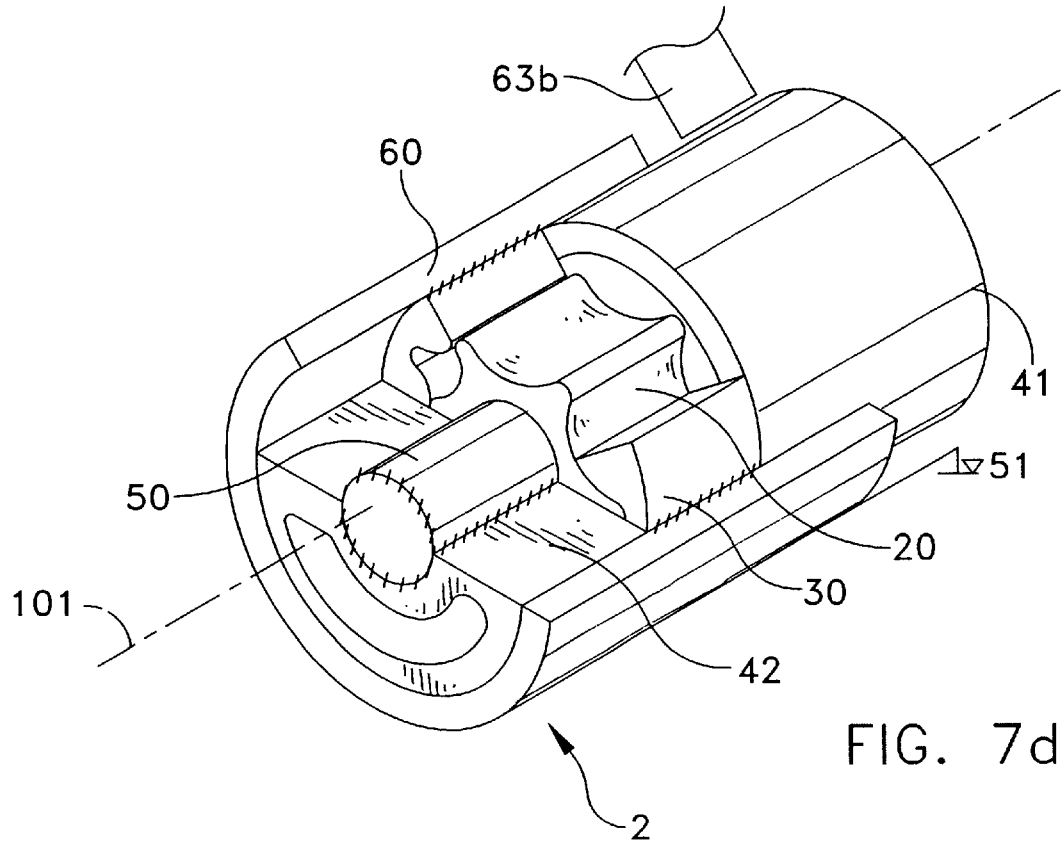

The pump can be driven—instead of via the shaft 50 with direction of rotation A—also via the casing 60 which is illustrated by embodiments in FIGS. 7*c* and 7*d*. It is likewise possible to reverse the drive direction in order then to obtain the conveying action of the micropump in a conveying direction from V to V'.

If all aforementioned pump components are adapted to be sufficiently describable with cylinder coordinates, they may as well be assembled in one axial direction, the assembly of the six basic components of one of the pump 1 and the motor 2 being effected by putting them together (uniaxially) only in said axial direction and by one of connecting them in a mechanically rigid manner and leaving them movable at certain predetermined sections (in the aforementioned border areas). This embodiment of a uniaxial assembly is advantageous for an automatized series production which is desirable for such small constructional sizes.

The conceptions of a pump 1 and a motor 2 shown in FIGS. 1 and 2 are specified for an embodiment in FIG. 1*a* and FIG. 2*a*, respectively, in which border areas presenting a fixed connection (for example glued or having positive fit) are indicated by hatched lines, whereas those border areas between two components which are not provided with hatched lines are adapted to be rotatable in relation to each other. In FIG. 1*a*, the two end inserts 41,42 are non-rotatably (fixedly) connected to the inner surface 61 of the sleeve casing 60. The border areas of the pump according to FIG. 2*a* are adapted to be rotatable. The pump according to FIG. 1*a* is provided with a further fixed connection between the shaft 50 and the inner rotor 20, whereas said connection is adapted to be rotatably movable in the motor according to FIG. 2*a*, instead the motor of FIG. 2*a* has a border area between the casing 60 and the outer wheel 30 which is nonrotatably connected, said border area being rotatably movable in the pump 1 according to FIG. 1*a*.

Figure 6A:
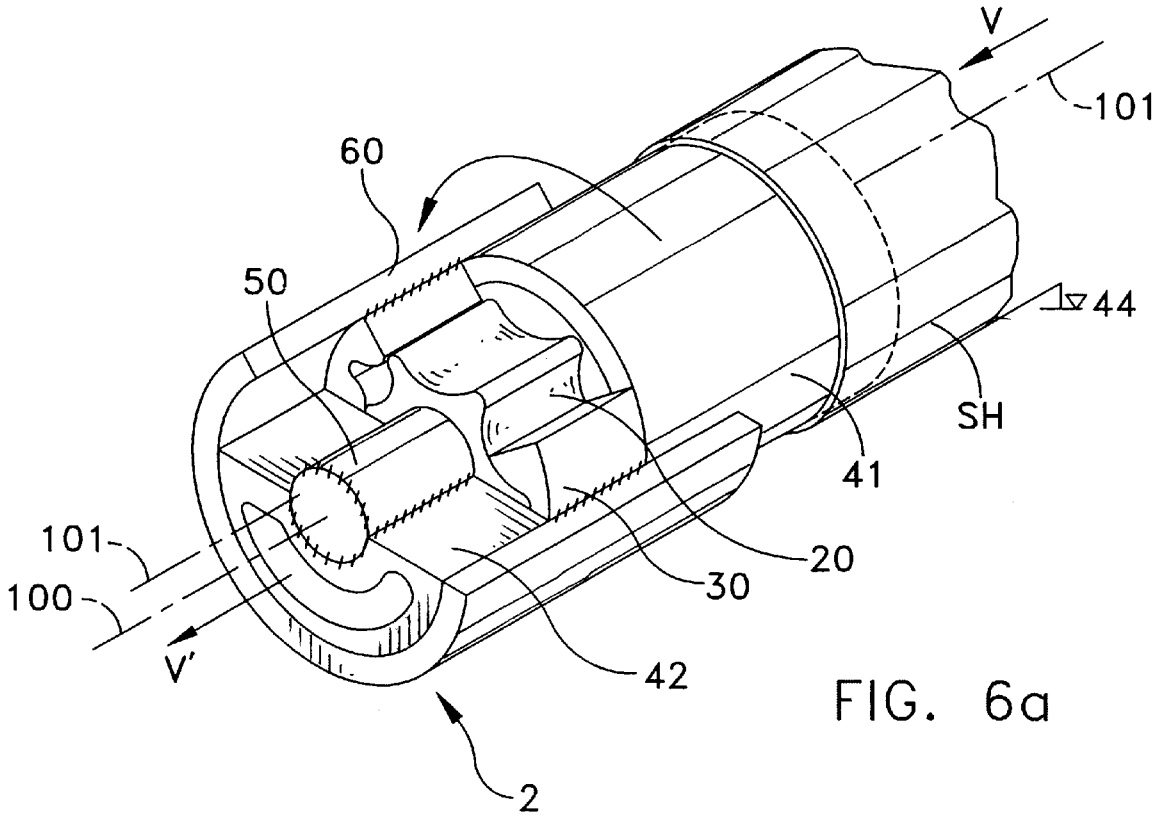
FIG. 6*a*, FIG. 6*b* and FIG. 6*c* are embodiments illustrating connections for a tubing SH through which a fluid for driving the motor 2 is entered. The tubing is mounted not to be rotatable.
Figure 6B:
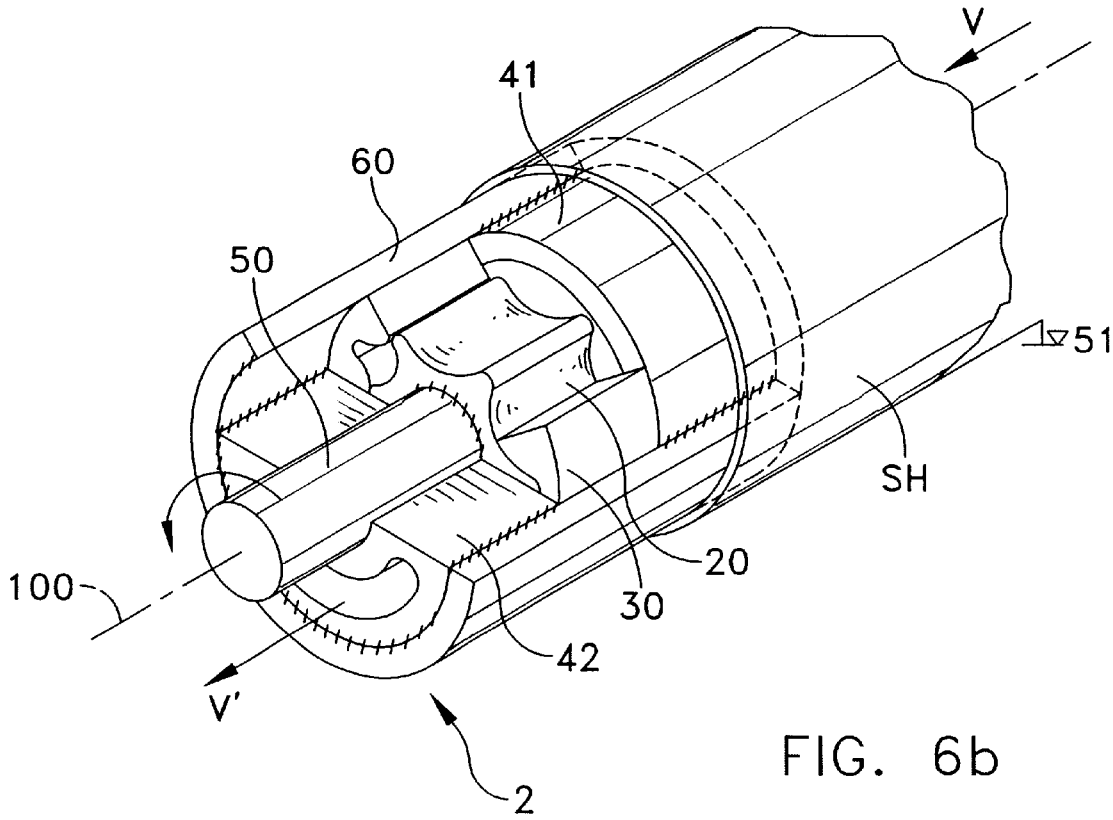
Figure 6C:
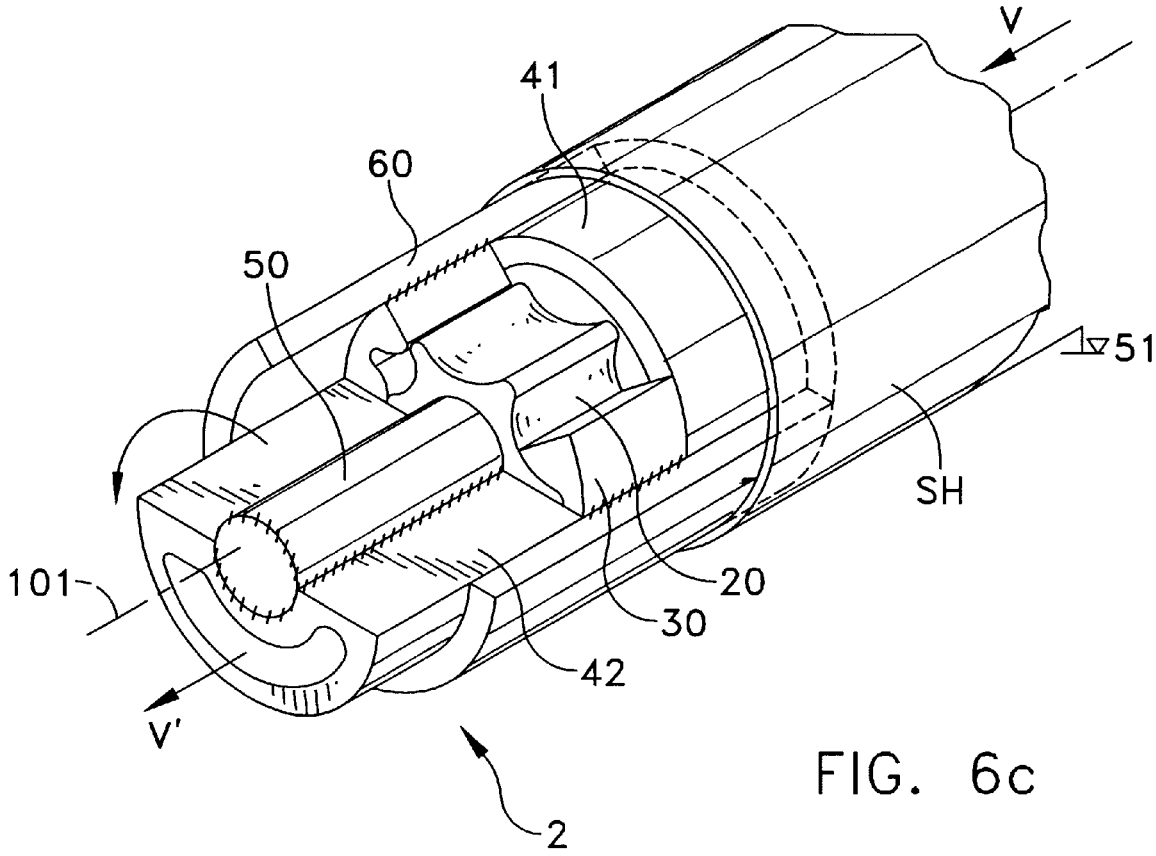

Further embodiments of the motor 2 are illustrated in FIGS. 6*a*, 6*b* and 6*c*; further embodiments of pumps are shown in FIGS. 7*a*, 7*b*, 7*c* and 7*d*.

In FIG. 6*a*, a fluidic motor is shown, which is provided with a drive fluid V through a tubing SH. Said tubing is fixedly plugged on the end insert 41 (basic support or basic component) extending in direction of an axis 101. Thus, the basic support 1 does not rotate, instead the inner rotor 20 and the outer rotor 30 rotate, which latter drives the casing 60. The tubing SH is exemplarily adapted to have a mechanically immobile support at position 44. FIG. 6*a* corresponds to FIG. 2*a* as far as the arrangement is concerned, FIG. 2*a* not yet showing said tubing SH. The basic component 41 is extended in axial direction for the mounting of the tubing SH to obtain an easy plug-on means. Accordingly, the tubing and the basic component have the same diameter, therefore, the tubing for entering a fluid V has a diameter corresponding to that of the motor 2. The output and thus the drive force is performed via the casing 60, accordingly the axis 101 of the casing is the axis of rotation.

In FIG. 6*b*, a tubing SH is firmly supported in relation to the environment, as schematically represented by reference numeral 51. The firm support may also be provided by the inherent stiffness of the tubing SH without requiring a firm support directly at the motor 2. In this embodiment, the tubing SH is put on the casing 60, a drive being effected via the shaft 50, an axis 100 being the axis of rotation. In the present embodiment, the shaft 50 is extended in axial direction to mechanically couple the drive output. As far as the hatched border areas and the corresponding non-rotatable connection are concerned, reference is made to the aforementioned specification.

In FIG. 6*c*, a tubing SH is also coupled to the casing 60, alternatively to an end insert 41 prolonged in backward direction. In the present embodiment, the drive output is realized over an axially extended cover 42, which is the second end insert on the front face end of the pump 2. An axis 101 (casing axis) is the axis of rotation, the shaft 50 has a slight radial runout, i.e. the axis of rotation 100 moves along an orbital path.

FIG. 7*a* illustrates an embodiment of a pump corresponding to that of FIG. 1*a*, a shaft 58 being provided which applies a rotary force "d" on a shaft 50 extended in axial direction. Reference numeral 100 designates the axis of rotation (the axis of the shaft 50), the casing 60 does not move and is coupled in a mechanically rigid manner at position 51. In FIG. 7*a*, the inner rotor 20 and the outer rotor 30 rotate inside the casing 60. The two end inserts 41 and 42, which do not have to be axially prolonged, are adapted to be rigidly mounted inside the casing 60.

In FIG. 7*b*, a coil arrangement 63 is shown coupling an electromagnetic field into the pump 1. The rotor of this embodiment, which is adapted to be a synchronous motor, is the outer wheel 30, which may for example be provided as a permanent magnet. In this embodiment, the casing 60 has to be arranged fixedly and simultaneously permit the passage of electromagnetic fields, thus it has to be made e.g. from plastics or ceramics. In FIG. 7*b*, the rotatable components are the outer rotor 30 and the inner rotor 20 inside the casing 60. The two rotors 20 are supported in said end inserts 41,42 by a fixed coupling between inner rotor 20 and shaft 50, said inserts being fixedly mounted at the casing 60. The axis of rotation of the outer rotor 30 is the axis 101 of the casing, the axis of rotation is the axis 100 of the rotating shaft 50. An inlet 41*n* and an outlet 42*n* are immobile in circumferential direction and thus arranged at a radially defined position.

FIG. 7*c* illustrates a mechanical drive over a pinion or a driving gear 63*a* engaging at the casing 60 in circumferential direction and essentially without slip. The axis of rotation of this arrangement is the casing axis 101. The end insert 41 does not move and is extended in axial direction to provide a mechanical fixing 44. The outer rotor 30 is fixedly mounted at an inner jacket surface 61 of the casing 60. The inner rotor is provided on the shaft 50 to be rotatably movable, whereas the shaft 50 itself is arranged not to be rotatable on the two end inserts 41,42, which in turn are supported at the inner jacket surface 61 of the casing 60. With the present arrangement of the pump 2 according to FIG. 7*c*, a practical test was effected according to FIG. 5, in which a cylindrical ring 63*a* arranged in circumferential direction was used as a driving gear or pinion.

FIG. 7*d* illustrates another embodiment of a driving gear or pinion 63*b* provided as drive at the axially prolonged end insert 41, a casing 51 being fastened in a mechanically fixed manner. The axis of rotation is constituted by the axis 101 of the casing, the shaft 50 slightly wobbles, i. e. an axis of rotation 100 of the shaft 50 moves on an orbital path.

In the same way as FIG. 7*b* shows a pump electromagnetically driven according to the synchronous principle, FIG. 7*d* may be transformed into such a synchronous embodiment by the mechanical engagement pinion 63*b*, the basic support 41 being provided with a corresponding permanent magnet. In this case, one of a metallic and non-metallic design may freely be selected for the casing 60.

Figure 4:
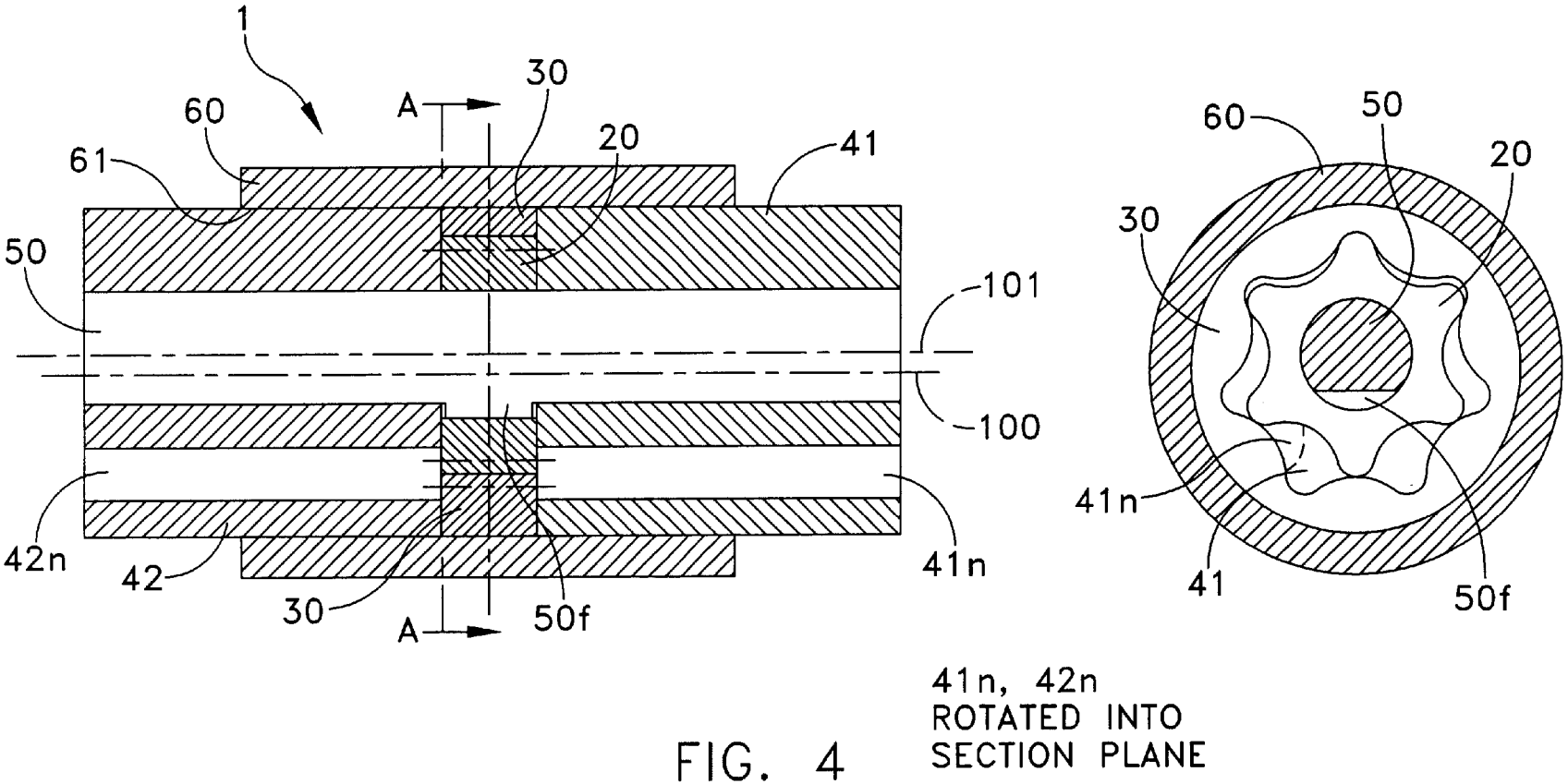
FIG. 4 shows both, a side view of a casing 60 with two inserted face end parts 41,42, and a sectional view A—A.

The operational principle according to FIG. 3, wherein a number of circumferentially moving sealing lines are provided delimiting individual conveyance chambers between them, which on one half side of the pump increase (suction side) and on the opposite half side (pressure side) decrease from a maximum size, is shown again in FIG. 4 in a side view. In the sleeve casing 60, the two face end inserts 41,42 are arranged concentrically and between the end inserts 41,42, rotors 20 and 30 are shown, which are represented in FIG. 3 in a top plan view for a definition of the sealing lines. An inlet kidney 41*k* and an outlet kidney 42*k*, which are schematically illustrated in FIG. 3, are turned to the sectional plane in FIG. 4 to make visible that they lead directly to the outward directed face ends of the rotors 20,30. A non-rotatable attachment between the shaft 50 and the inner rotor 20 is realized by providing a flat section 50*f*, said section allowing a positive force transmission in addition to an attachment by gluing.

Figure 5:
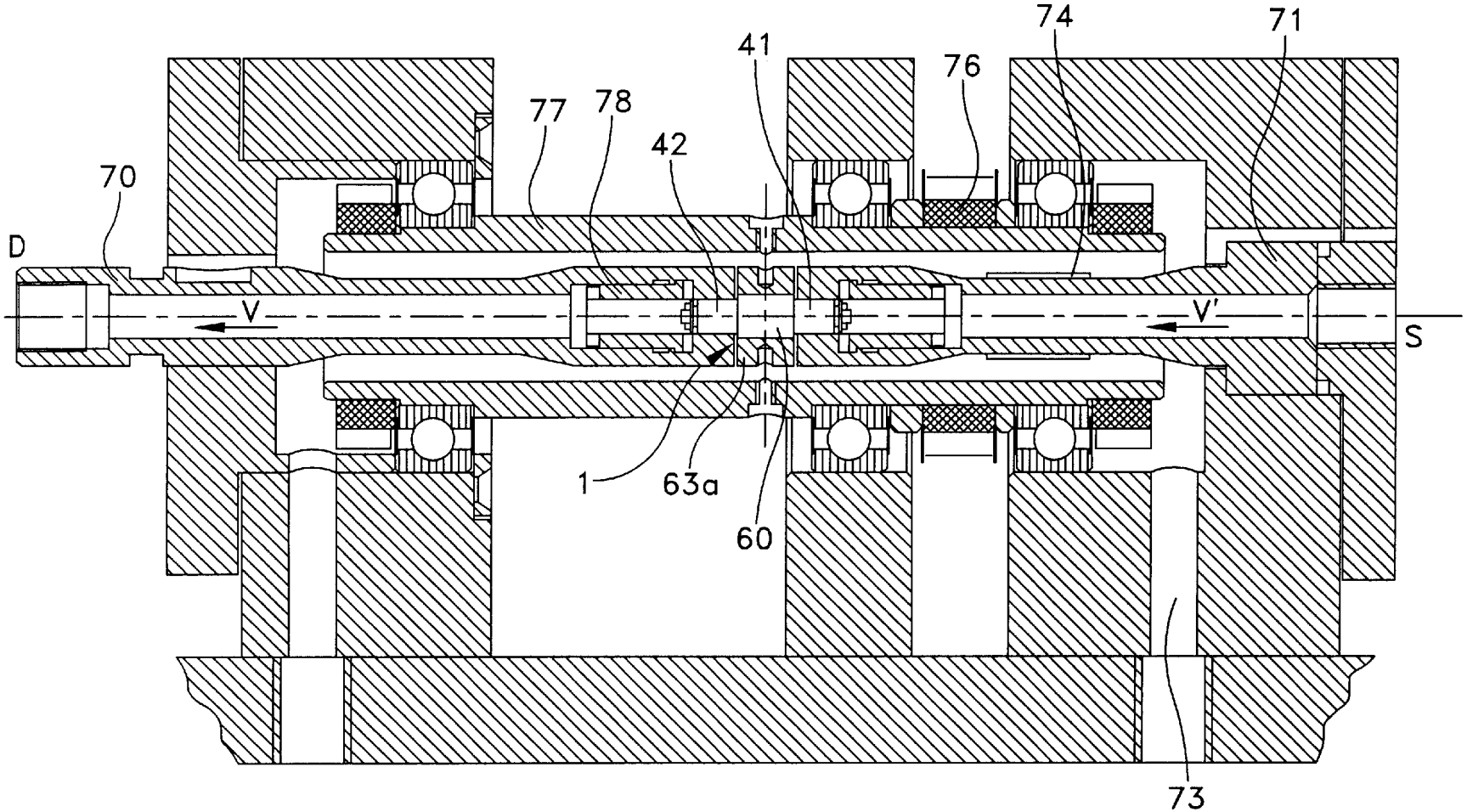
FIG. 5 shows an arrangement wherein, in a practical experiment, a pump 1 is provided in a conveying channel leading from a suction end S to a pressure end D. In this embodiment, a circumferentially directed driving force to a casing 60 of the pump 1 is selected.

The structure of the pump was already explained in FIG. 7*c*. In FIG. 5, said pump was tested in a practical experimental arrangement with regard to its performance values and characteristic data. The pump is visible in the middle of FIG. 5, an inflow and an outflow lead the supplied fluid V' to be pumped from the suction side S through the pump 1 in the direction of a pressure side D where the fluid V is under an increased pressure. Pressures that could be obtained with a pump arrangement of this kind were of a difference pressure of about 50 bar, at a pump performance of 200 ml/min, whereby it should be added that the pump 1 had a casing 60 of an outer diameter of the order of 10 mm.

As far as FIG. 5 is concerned, which is self explanatory, it should be mentioned that the drive casing 63*a* was fixedly coupled to the casing 60 of the pump and the driving power was transmitted to the pump over a drive tube 77 arranged centrically. Adaption casings are arranged at the end inserts 41, 42 which were extended in the axial direction, said adaption casings serving for non-rotatably supporting the end inserts 41,42 as illustrated in FIG. 7*c*. For measurement purposes, a wire resistance strain gauge DMS 74 is disposed around an inlet tubing 71. Bores 73 provided in the measurement arrangement serve for the detection of leakages during conveyance and, as illustrated schematically, a drive 76 is adapted to be in engagement with a drive tubing 77.

The arrangement according to FIG. 5 allowed to test the basic data and performance limits of the pump 1.

In the fluidic micropump 1, a fluid is pumped through a rotating displacement piston 30/20 changing its chamber volumes by rotation in a way to permit a fluid to be continuously sucked in through the inlet 41*n* and to be continuously discharged on the outlet side 42*n*. In contrast to most of the other prior art pump systems, the invention also permits a reverse operation mode as a fluidic motor.

Due to a fluidic transmission of energy, the systems proposed by the invention are characterized by a high power to weight ratio, high pressures to be generated, high driving torques and high flow rates.

As manufacturing processes for a prototype realization of such motor/pump systems, the processes of wire spark erosion and cavity sinking may be used. Actual wire spark erosion machines operate with resolutions of 0.5 $\mu$m and achieve contour tolerances of 3 $\mu$m at surface roughnesses of a minimum of Ra=0.1 $\mu$m. Machines operating with more exactness and fineness are actually being developed. On the one hand, the erosion methods may be used directly for the manufacturing of prototypes of micropumps/micromotors, on the other hand, these methods permit an industrial scale manufacture of molds and tools for the production of components according to alternative manufacturing methods in large series (ceramic, metal, plastics). The mentioned alternative methods for the manufacturing of motor and pump components may be one of extrusion molding, fine sintering, injection molding and diecasting. Other manufacturing methods, such as the LIGA-method, seem to be suited as well.

The following results are obtained with the erosion manufacturing method:

Inexpensive and simple manufacture of individual components and small series

Large width/height ratios (aspect ratios up to a maximum of 12 mm; compared to the LIGA method: 1 mm)

Wall inclinations up to 30.degree. permitted

Processing of very different and hard materials permitted if they are electrically conductive, such as hard metal, silicium and electrically conductive ceramic materials.

Technology with low technological risk.

The advantages of hydraulic micromotors and micropumps:

Simple structure

Resistant, insensitive against pollutions

No valves required

Pump direction and rotating direction of the motor directly reversible

High driving torques

High weight coefficient

Characteristic line of torque/speed relatively inflexible.

Drive medium (fluid) of the motor may be used for cooling or rinsing

No electrical connections required (e.g. in explosion-proof environment or for operations on the brain or on the heart).

Fields of application of the micropump and the fluidic micromotor:

microhydraulic aggregate: coupling the micropump with a motor for the generation of hydraulic energy analysis/dosing pump: for a removal and output of exactly defined fluid volumes in chemistry, medicine, food industry, mechanical engineering.

volume counter/flowmeter: application in measurement techniques heating burner pump.

drive for a micro milling cutter for medical and technical applications endoscopic drive dilatation catheter with an integrated micropump for maintaining the bloodstream during a balloon dilatation medication catheter with an integrated micropump for maintaining the bloodstream during a medication (e.g. lysis treatment)

bloodstream support pump control aggregate for ultrasonic mirrors (transducers) in catheters drive for a rotating cutting tool provided on endoscopes, catheters miniature generator: coupling the fluidic micropump with an electrical miniature generator for the generation of electric energy pumps for fluidic and hydraulic microsystems compressor for a miniature cooling aggregate: e.g. for the cooling of processors)

driving elements for large controlling torques sun antiglare device: in multiplex panes, a light-absorbent liquid is pumped between the panes.

The contour of the rotors 20,30 is an equidistant of one of an epicycloid and an hypocycloid and is calculated according to a generally known formulation.

The basic components of the micropump are:

basic support (first end insert) 41
shaft 50
cover (second end insert) 42
inner rotor 20
outer rotor 30
casing 60.

According to FIG. 2*a*, the inner rotor 20 and the shaft 50 of the micropump 1 are fixedly connected. A cover 42 and a basic support 41 are also fixedly connected with each other over the casing 60. The connections may be provided as an adhesive connection, a press fit, one of a weld and a solder connection, etc. The pump 1 is driven by rotating the shaft 50, e. g. by one of an electrical micromotor, a micromotor 2 driven by a fluid according to FIG. 2*a* and a flexible shaft 58 according to FIG. 7*a*. Consequently, a fluid is pumped from the basic part 42 in the direction of the cover 42 or vice versa, depending on the direction of rotation.

A micromotor 2 according to FIGS. 2,2*a* is provided with a basic part 41 and a cover 42 which are fixedly connected with the shaft 50. Further, the outer rotor 30 is connected with the casing 60. A fluid under pressure is supplied at the inflow side of the basic part 41 to operate the motor. Consequently, the casing 60 (drive output A') rotates around its axis 101. The fluid leaves the micromotor at the outlet side with less pressure than at the inlet side. After deduction of the losses, the pressure difference is transformed into mechanical energy. Changing the pressure side and the outlet side results in a reversal of the direction of rotation A' of the motor.

The micropump 1 and the micromotor 2 operate on the basis of the displacement principle. The operating chambers 20*a*,20*b* cyclically enlarge and reduce in volume, as described according to FIG. 3.

A fluid under high pressure flows into the enlarging operating chamber of the micromotor 2 and effects a torque on the rotors 20,30 due to the pressure difference between inlet and outlet. The rotors 20,30 of the micropump 1 are driven. The fluid is sucked in by the enlarging chamber and is brought to a higher pressure when the chamber reduces in volume. The micropump 1 is driven by a small electric motor or by the fluidic micromotor 2. Further embodiments of drives are provided by corresponding shafts.

FIG. 3 show that the fluid, when being pumped, is supplied into the pump chamber 20*a*, 30*a* via the suction side, it is ejected via the pressure side. For a clear understanding, a tooth of the inner rotor is marked by a black point in FIG. 3. For the micromotor, the pump principle is simply reversed. When operated as a motor, a high pressure is provided in the chamber 20*a*, 30*a* via the inflow on the inflow side, the pressure having an effect on the tooth flanks and generating a force which is larger than the counterforce on the outlet side, since there, the pressure is reduced. The resulting torque drives the motor.

Modifications

Instead of by shaft 50, the pump 1 may also be driven over the casing 60 (FIGS. 7*c*, 7*d*). The advantage of such a drive is that the casing 60 may be driven via an inflexible drive, whereas, in case of driving the shaft 50, which wobbles, a flexible connection piece is used.

The drive output A' of the motor 2 may also be effected at the shaft 50 instead of the casing 60. In this embodiment, the output is connected over a flexible connection piece or a jointed shaft. The advantage of such a drive is that the outflowing drive fluid does not have to pass through a possibly connected tool, but is permitted to flow out therebehind or to be returned.

In compensation of an axial gap between the combination of the inner/outer rotor 20,30 and the joining basic part 41 and cover 42, additional compensation pockets 41*k*,42 may be provided at the basic part 41 and the cover 42 (axial gap compensation).

Bores 41*d*, 41*e*, 41*f*, 41*g*, 41*h* provided in the basic part and the cover, through which bores the fluid is supplied or discharged, may, in case of sensible fluids (e. g. blood) also be connected with each other in the form of a kidney 41*n*, 42*n*, as illustrated in FIG. 8 by reference numeral 41*n*.

For the reason of a reduced friction, a hydrodynamic bearing may be used for the fluidic micromotor 2 instead of a slide bearing. In this case, the fluid for the bearing is introduced at the inflow side.

According to a further embodiment, also one of miniature ball bearings, roller bearings and stone bearings may be used instead of sliding bearings to reduce the friction.

The friction may also be reduced by coating the surfaces of the components with a friction-reducing layer, e.g. graphite or teflon.

A consequence of the operation principle of the motor 2 is a unilateral (de)flection of the shaft 50. The unilateral radial gap resulting therefrom may be compensated by a radial gap compensation.

For medical applications, a physiologic fluid, such as a salt solution or blood plasma, may be used as a medium for driving the micromotor 2.

For the speed control and for the detection of the turning angle, the fluidic micromotor/micropump may be provided with an angular shaft encoder consisting of fiber optical waveguides, scanning the positions of the teeth of the inner and outer wheel 20,30. Thereby, an exact detection of the turning angle of one of the motor and the pump and an exact speed control are obtained.

The speed control and the detection of the turning angle, respectively, may alternatively be realized by an integrated pressure sensor measuring the pulsation of the pressure in the chamber and thus forwarding the turning angle to the control means.

The micropump 1 and the micromotor 2, respectively, may be provided with a pressure sensor and related electronic drive means to constitute a complete microsystem. Further, one of switch-on/switch-off/overpressure/pressure relief and check valves may be integrated. By providing fluidic, electrical and optical interfaces, a completely closed microsystem may be realized.

Alternative manufacturing methods are fine sintering (metal, ceramics), extrusion molding, wire spark erosion and cavity sinking, diecasting, injection molding, micromilling, laser cutting. For an inexpensive production, a method should be applied which works according to the multiple use principle. The manufacture of large batch numbers and the use of automatized assembly methods, similarly to chips, allow an inexpensive production of micropumps and micromotors, eventually even as throw-away articles, since the consumption of material and energy is relatively small.

The inlet and the outlet, respectively, of the fluidic micropump 1 and micromotor 2 is effected in the direction of the rotating shaft 50. The background thereof is, that the motor may simultaneously serve as a tool support and in this case, the fluid inlet is effected from the other side. Such a structure of the pump and the motor is adapted to medical applications and permits a very small cross-section. The use of another structure allows lateral inlet openings by providing reversing guides.

Further, due to the present structure, the micropump and the motor may consist of a minimum total number of components. Therefore, all components of the pump are adapted to be manufactured as 21/2-D structures (prismatical shape provided by extrusion of an even curve into the space).

The fluidic micromotor 2 is an open system. The drive medium (fluid) freely leaves the outlet 42*n* to enter the operation environment. The system not being encapsulated, leakage losses also freely discharge into the operation environment at the bearing positions. The term of an "open system" is closely related to the abovementioned structure consisting of a very small number of components. Known embodiments encapsulate the entire system, regardless whether motor or pump, due to the use of oil as energy carrier. The present embodiment is based on the fact that the drive fluid and the pumped fluid, respectively, are adapted to be discharged into the environment. In medical systems, this allows the tool to be cooled and the treated area to be rinsed; this may also be used in technical systems (e. g. drilling tools, etc.).

As far as the constructive design of the open system is concerned, bearing gaps of a sufficient length between the basic part 41, the cover 42 and the rotating casing 60 are to be provided, the gaps preventing a suction of false air by a labyrinth seal effect. Further, the open structure permits the use of simple hydrodynamic bearings for basic part-casing and cover-casing.

The casing 60 of the micromotor 2 is supported by a bearing consisting of basic part 41 and cover 42. Conventional systems are in most cases supported over the surrounding casing. Said systems present a closed power flux. The motor 2 as proposed by the present invention is provided with a fixed connection between the so-called basic part 41 and the cover 42 via the shaft 50 connecting both parts fixedly and rigidly with each other.

The base part 41 and the cover 42 as well as the shaft 50 connecting them are secured against torsion by one of a flattened axial section and a glue. Other joining techniques, welding, soldering, shrinking connection by heating the casing and cooling the cover and the basic part may also be applied.

The pump direction is reversed by simply reversing the direction of rotation of the drive. This is valid correspondingly for the motor: The direction of rotation of the motor is reversed by changing the pressure and the suction side. The particular construction of the micropump according to FIG. 1*a* and of the micromotor according to FIG. 2*a* allows an operation as a motor and as a pump, if the system is driven externally (shaft in FIG. 1*a* and casing in FIG. 2*a*) in case of an operation as a pump.

The casing 60 of the micromotor may be used directly as a tool support. As a respective embodiment, a milling tool is mentioned. Such a tool is hollow inside and has an integrated rinsing means adapted to be used as one of a cooling and a chip removal means.

A beam waveguide for detecting and controlling the speed may be added to the systems. In this respect, the rotating teeth 20*a*, 20*b* are scanned at a position suited to allow an incremental detection of the rotating speed as well as of the turning angle.

The micromotor 2 is particularly adapted for medical applications. In this respect, it may be used as a support for cufting tools, milling tools, sensors (particularly ultrasonic sensors, mirrors, etc.), actuators for endoscopes and other medical instruments to be moved. When used in medical systems, the micromotor presents advantages with regard to its body-compatible drive medium; electrical components, generating electromagnetical fields when used and thus having negative effects for example on nerve tracts, etc. are dispensed with; hydraulic components provide a maximum power density and thus allow minimum constructional sizes.

Due to their structure, the fluidic micromotor and the micropump are to be easily cleaned and sterilized and are therefore well adapted for medical application.

In applications not requiring maximum tightness, the components may be manufactured to have a relatively large clearance thus permitting the use of inexpensive. manufacturing technologies such as for example injection molding. These systems are manufactured for single use.

The drive medium (fluid) may be used as one of a coolant, lubricant and rinsing medium.

The openings on the inlet and outlet side may have different shapes according to FIG. 8. Accordingly, a continuous kidney 41*n* (A in FIG. 8) may be provided which is arranged in the basic part 41 and the cover 42. This shape may alternatively be approached by bores 41*d*, 41*e*, 41*f* . . . 41*h* (B in FIG. 8), providing these components with a higher stability, since webs between the bores 41*d* to 41*h* substantially increase the stability. The diameters of the bores 41*d* to 41*h* disposed circumferentially are continuously increasing.

In a further embodiment, one single continuous bore 41*b* is provided in combination with a kidney-shaped recess 41*k* (C in FIG. 8) not substantially weakening the stability but on the other hand allowing a sufficient flow rate. Particularly in medical applications, where blood is pumped, the blood cells are treated with care, the risk of shearing being substantially reduced.

The shapes shown in FIG. 8 on the inlet side of the basic support 41 are also applicable for the outlet side (cover 42).

While the present invention has been described at some length and with some particularity with respect to several described embodiments, it is not intended that it should be limited to any such particulars or embodiments or the particular embodiment, but is to be construed broadly with reference to the appended claims so as to provide the broadest possible interpretation of such claims in view of the prior art and, therefore, to effectively encompass the intended scope of the invention.

We claim:

1. Micropump of miniature size, said micropump comprising a sleeve casing, an axis of said sleeve casing, an axis of rotation and an inner rotor provided with teeth, said micropump having at least one outlet pressure opening to extend in a direction of said axes, whereby both axes are radially offset with respect to each other and (a) said sleeve casing having a diameter of less than 10 mm and said inner rotor is in a meshing engagement with an outer rotor such that each tooth of said inner rotor forms an axially extending sealing line on an inner surface of said outer rotor;

(b) said at least one outlet pressure opening is provided in a first face end part, terminating and attached to said sleeve casing;

(c) both, said inner rotor and said outer rotor having a diameter of less than 10 mm, to substantially continuously convey a mass flow upon a rotational movement of the sealing lines.

2. Micropump according to claim 1, having an inlet opening in a second sleeve casing termination part attached to the other face end of said sleeve casing, said inlet opening extending in direction of said both axes.

3. Micropump according to claim 2, wherein a kidney-shaped groove is provided on an inner surface of each of said sleeve casing termination parts.

4. Micropump according to claim 3, said grooves leading into a major portion of one half of a number of conveyance chambers between said inner rotor and said outer rotor, said chambers changing in volume by meshing and during movement of said sealing lines.

5. Micropump according to claim 3, wherein an inner surface of at least said first termination part is in substantially tight contact with neighbored surfaces of both said inner rotor and said outer rotor.

6. Micropump according to claim 2, wherein said inlet opening and said outlet opening are arranged on axially opposite ends of said sleeve casing and radially offset at an angle of substantially 180° with respect to the axis of said sleeve casing.

7. Micropump according to claim 1, further comprising a shaft, extending in and along the direction of the axis of rotation.

8. Micropump according to claim 7, said shaft extending on one face end of said sleeve casing longer in said direction of the axis of rotation than on an other face end of said sleeve casing, to provide a coupling for a mechanical rotatory force.

9. Micropump according to claim 7, wherein one of the components of said micropump being adapted to be accessible for an electromagnetic field.

10. Micropump according to claim 9, said field effecting a rotary momentum on at least one of said outer rotor and said sleeve casing, for moving said sealing lines in a rotary movement.

11. Micropump according to claim 1, having gaps for minor conveying losses on an inside surface of said sleeve casing, said losses resulting from one of minor differences in diameter and manufacturing tolerances, for providing a rotary bearing.

12. Micropump according to claim 1, said sleeve casing having a diameter of less than substantially 3 mm.

13. Micropump according to claim 1, said sleeve casing having an axial length of less than 10 mm.

14. Micropump according to claim 13, said axial length being shorter than substantially 4 mm.

15. Micromotor of miniature size, comprising (a) an inner rotor provided with a meshing engagement to an outer rotor, said two rotors being interposed between two axial termination parts arranged opposite and axially spaced apart from each other;

(b) a sleeve casing having a diameter of less than 10 mm, an axis of said inner rotor and an axis of said sleeve casing being offset with respect to each other, said offset being less than 10 mm; wherein (c) one of an extension of said sleeve casing and one of said two axial termination parts being adapted to be fixed to an inlet tubing, to supply a driving fluid through said tubing to an inlet opening of one of said axial termination parts and between said rotors for providing a rotational force upon a streaming driving fluid.

16. Micromotor according to claim 15, having an outlet opening extending in axial direction and in parallel with respect to said axes of said sleeve casing and said inner rotor.

17. Micromotor according to claim 15, having a diameter of less than substantially 3 mm.

18. Micromotor of claim 15, having an axial length of less than 10 mm.

19. Assembly method for one of a micropump and a micromotor, said micropump and micromotor having components of cylindrical shape and having an axial assembly direction, said method comprising:

(a) providing first and second axial termination parts and a casing having a diameter of less than 10 mm;

(b) assembling said first and second termination parts along a first direction to said casing;

(c) providing an inner rotor and an outer rotor having a diameter of less than 10 mm and having axes offset in relation to each other;

(d) assembling said rotors along a second direction into said casing prior to assembling the axial termination parts;

first and second directions being along the axial assembly direction.

* * * * *